US006889953B2

(12) United States Patent
Harbaugh

(10) Patent No.: US 6,889,953 B2
(45) Date of Patent: May 10, 2005

(54) UMBRELLA STAND

(75) Inventor: Kenneth A. Harbaugh, Douglasville, GA (US)

(73) Assignee: Southern Sales & Marketing Group, Inc., Atlanta, GA (US)

( * ) Notice: Subject to any disclaimer, the term of this patent is extended or adjusted under 35 U.S.C. 154(b) by 62 days.

(21) Appl. No.: 10/247,230

(22) Filed: Sep. 19, 2002

(65) Prior Publication Data

US 2004/0056169 A1 Mar. 25, 2004

(51) Int. Cl.[7] ..... F16N 13/00

(52) U.S. Cl. ..... 248/519; 135/16; 248/539; 248/910

(58) Field of Search ..... 248/519, 523, 248/910; 135/16, 97, 98

(56) References Cited

U.S. PATENT DOCUMENTS

| | | | | | |
|---|---|---|---|---|---|
| 5,207,406 | A | * | 5/1993 | Stine et al. | 248/514 |
| 5,354,031 | A | * | 10/1994 | Bilotti | 248/519 |
| 5,377,976 | A | * | 1/1995 | Matherne et al. | 473/483 |
| 5,632,480 | A | * | 5/1997 | Davis et al. | 473/483 |
| 5,937,882 | A | | 8/1999 | Harbaugh | |
| 6,446,930 | B1 | * | 9/2002 | Li | 248/519 |
| 2002/0028716 | A1 | * | 3/2002 | Gormley | |

* cited by examiner

*Primary Examiner*—Ramon O Ramirez
(74) *Attorney, Agent, or Firm*—Kilpatrick Stockton, LLP

(57) ABSTRACT

An umbrella stand includes means defining a cavity, a mast receiving means operatively associated with the cavity-defining means, a bladder received within the cavity and comprised of a material which will retain ballast, and ballast contained within the bladder. When an umbrella mast is inserted into the mast receiving means and the umbrella is raised, the ballast weighs down the cavity-defining means so as to maintain the umbrella in a generally upright condition.

14 Claims, 12 Drawing Sheets

UMBRELLA STAND

TECHNICAL FIELD

The present invention relates generally to umbrellas and relates more specifically to an umbrella stand for maintaining an umbrella in an upright position.

BACKGROUND OF THE INVENTION

Patio umbrellas are well known in which an umbrella canopy is mounted to a mast to provide shade for a deck, patio, garden, or the like. If the umbrella is of a tilting design, then whenever the umbrella canopy is tilted such that its center of gravity is no longer directly above the umbrella mount, considerable torque is be exerted on the mount and may tend to cause the umbrella to topple over. Even win the umbrella canopy is not tilted, breezes can exert forces on the umbrella which tend to topple it. And in the case of side mast umbrellas, where the umbrella canopy is cantilevered out to the side of the mast, the torque exerted on the umbrella base by the dead weight of the umbrella canopy can be much higher, and even higher still on breezy days.

In applications where the umbrella will be used in only a single location, an umbrella base can be bolted to the underlying support structure, thus providing a sufficiently secure mount to resist such torque. However, in many applications it may be desirable to be able to move the umbrella around to various locations, or to be able to store the umbrella when not in use without an intrusive umbrella stand being left in place. Such applications call for portable umbrella stands. The portable umbrella stand must be able to withstand the forces exerted by the umbrella without toppling, and without being anchored to the supporting substructure.

The majority of portable umbrella stands rely on some form of ballast to weigh down the umbrella stand. Heavy objects such as concrete blocks must be purchased separately from the umbrella and positioned on the umbrella stand to prevent the umbrella from toppling over.

The requirement for ballast presents a number of problems. First, there is the requirement for obtaining the ballast. Costs of shipping packages of heavy weight make it economically impractical to include the ballast along with the umbrella. In addition, commonly used forms of ballast such as concrete blocks and the like will not fit within the typical umbrella box, which is only about ten inches wide by six inches deep. Further, many stores which sell patio umbrellas do not sell concrete blocks or other suitable objects for use as ballast, meaning the purchaser must travel to another store after purchasing the umbrella to obtain the ballast. In addition, there is the problem of the umbrella owner having to haul heavy concrete blocks to the location where the umbrella will be used. Then, when it is desired to take the umbrella down, the heavy ballast must again be carried to a storage location.

Thus there is a need for an improved portable umbrella stand.

There is a further need for an portable umbrella stand in which the entire device can be shipped in the same shipping carton with the umbrella.

There still a further need for an improved portable umbrella stand which does not require the umbrella purchaser to make a trip to a store separate from the store from which the umbrella is purchased in order to obtain suitable ballast.

Further, there is a need for an improved portable umbrella stand in which the umbrella purchaser does not have to carry ballast to the location where the umbrella will be used.

SUMMARY OF THE INVENTION

As will be seen, the present invention overcomes these and other shortcomings associated with prior art umbrella stands. Stated generally, the present invention comprises an improved portable umbrella stand in which the entire device can be shipped in the same shipping carton with the umbrella. Thus there is no need for the umbrella purchaser to make a trip to a store separate from the store from which the umbrella is purchased in order to obtain suitable ballast. Further, the umbrella owner does not have to lug ballast to the location where the umbrella will be used.

Stated more specifically, the present invention comprises an umbrella stand having a cavity and a mast receiving means. A bladder is received within the cavity and is comprised of a material which will retain ballast, for example, water. The bladder is positioned within the cavity in the stand and then filled with ballast. When an umbrella mast is inserted into the mast receiving means and the umbrella is raised, the ballast weighs down the stand to maintain the umbrella in a generally upright condition.

Objects, features, and advantages of the present invention will become apparent upon reading the following specification, when taken in conjunction with the drawings and the appended claims.

DETAILED DESCRIPTION OF THE DISCLOSED EMBODIMENT

Figure 1:
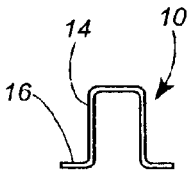
FIG. 1 is an end view of an upper cross brace of a first disclosed embodiment of an umbrella stand.
Figure 2:
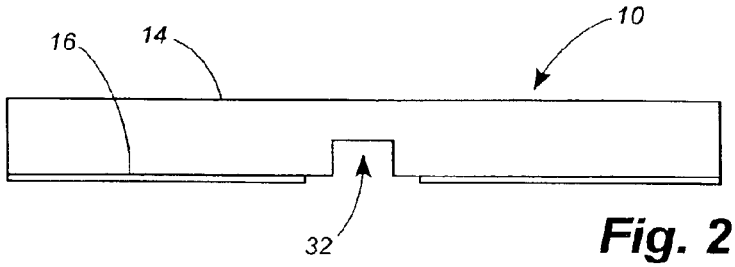
FIG. 2 is a side view of the upper cross brace of FIG. 1.
Figure 3:
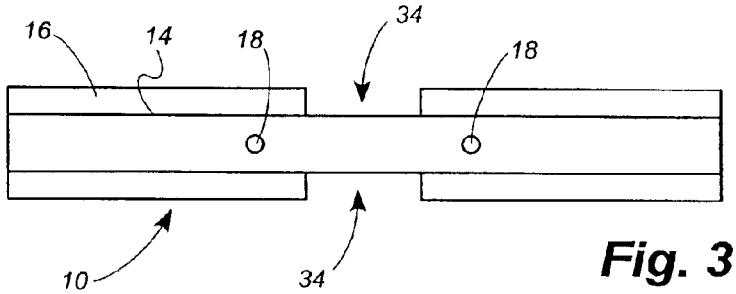
FIG. 3 is a top view of the upper cross brace of FIG. 1.
Figure 4:
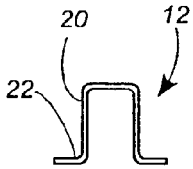
FIG. 4 is an end view of a lower cross brace of the first disclosed embodiment of the umbrella stand.
Figure 5:
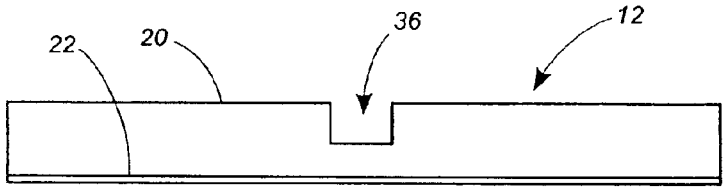
FIG. 5 is a side view of the lower cross brace of FIG. 4.
Figure 6:
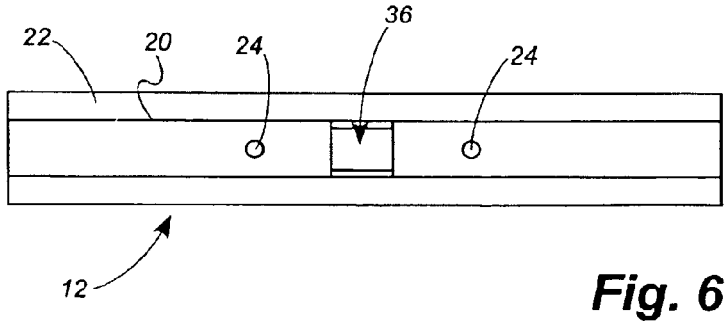
FIG. 6 is a top view of the lower cross brace of FIG. 4.

Referring now to the drawings, in which like numerals indicate like elements throughout the several views, FIGS. 1–3 depict an upper cross base member 10, and FIGS. 4–6 depict a lower cross base member 12. As will be described below, the upper and lower cross base members 10, 12 assemble to form a cross base.

Referring to FIGS. 1–3, the upper cross base member 10 comprises a channel member 14 in the shape of an inverted "U." Flanges 16 project laterally outward from the lower ends of the channel member 14. A pair of threaded bores 18 are formed in the upper surface of the channel member 14.

Similarly, as shown in FIGS. 4–6, the lower cross base member 12 comprises a channel member 20 in the shape of an inverted "U." Flanges 22 project laterally outward from the lower ends of the channel member 20, and a pair of threaded bores 24 are formed in the upper surface of the channel member 20.

Referring again to FIG. 2, the upper cross base member 10 has a generally rectangular cutout 30 formed in the lower portion of the channel member 14. The cutout portion 30 is slightly wider than the width of the channel member 20 of the lower cross base member 12. The cutout portion 30 extends approximately halfway up the side of the channel member 14.

Referring now to FIG. 3, the central portions of the flanges 16 of the upper cross base member 10 are cut away. The cutaway 32 has a width slightly greater than in the distance from the outside edge of one flange 22 of the lower cross base member 12 to the outside edge of the opposite flange 22.

With reference now to FIGS. 5 and 6, the upper cross base member 12 has a cutout portion 36 formed in the upper portion of the channel member 20. The cutout portion 36 is slightly wider than the width of the channel member 14 of the upper cross base member 10 and extends approximately half way down the wall of the channel member 20.

Figure 7:
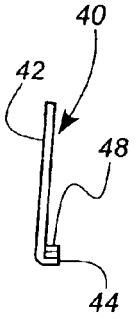
FIG. 7 is an end view of a side frame member of the first disclosed embodiment of the umbrella stand.
Figure 8:
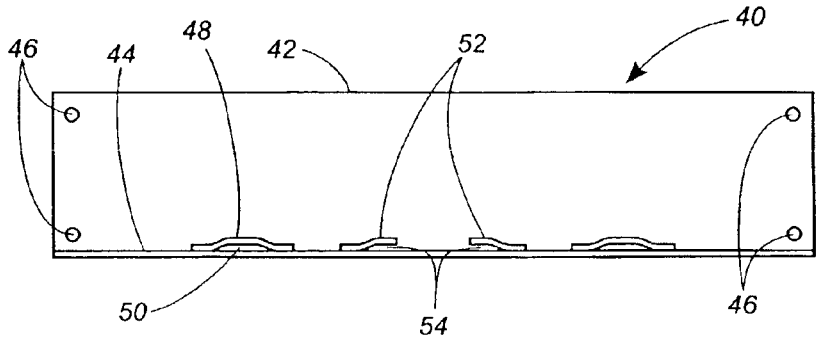
FIG. 8 is a side view of the side frame member of FIG. 7.

FIGS. 7 and 8 show a side frame member 40. The side frame member 40 is formed of sheet metal, plastic, or other suitable material and comprises a generally vertical panel 42 having an inturned flange 44 at its lower edge. Smooth bores 46 are formed in each corner of the panel 42. Brackets 48 are attached to the upper surface of the flange 44 at approximately one-quarter and three-quarters of the distance along the side frame member 40. An aperture 50 is formed between each bracket 48 and the adjacent portion of the flange 44. On either side of the halfway location along the side frame member 40, a pair of spaced apart brackets 52 form mutually facing C-shaped channels 54. The opposed brackets 52 are spaced apart by a distance equal to the width of one of the channel members 14, 20 of the upper and lower cross base members 10, 12.

Figure 9:
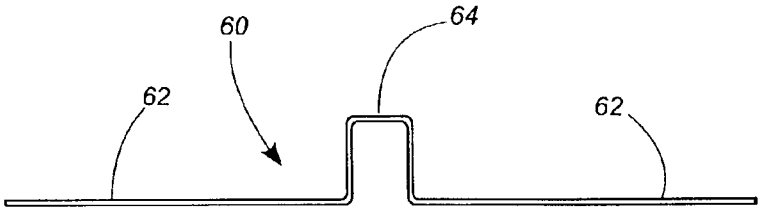
FIG. 9 is a side view of a base strap of the first disclosed embodiment of the umbrella stand.

A base support 60 is illustrated in FIG. 9. The base support 60 includes elongated strap portions 62 extending outward from a central portion 64. The central portion 64 is generally in the shape of an inverted "U" and is adapted to conform to the outer surface of one of the channel members 14, 20 of the upper and lower cross base members 10, 12.

Figure 10:
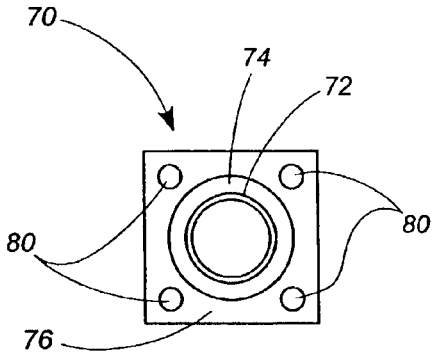
FIG. 10 is a top view of a mast receiver of the first disclosed embodiment of the umbrella stand.
Figure 11:
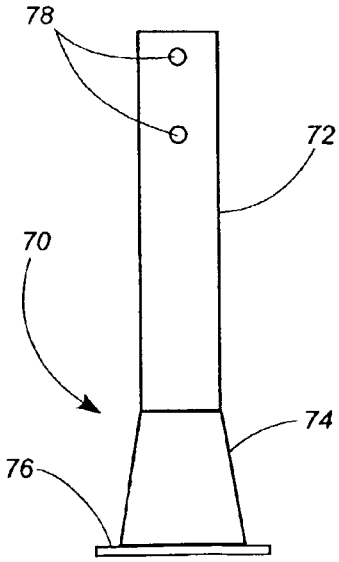
FIG. 11 is a side view of the mast receiver of FIG. 10.

FIGS. 10 and 11 show a mast receiver 70. The mast receiver 70 includes an upper tubular portion 72, a lower frustoconical section 74, and a base plate 76. The tubular portion 72 is configured to receive the lower end of an umbrella mast (not shown). A pair of holes 78 adjacent the upper end of the tubular portion 72 are adapted to align with corresponding holes in an umbrella mast to receive bolts or other fasteners for anchoring the umbrella mast to the mast receiver 70. Smooth bores 80 are formed in each corner of the base plate 76 of the mast receiver 70.

Figure 12:
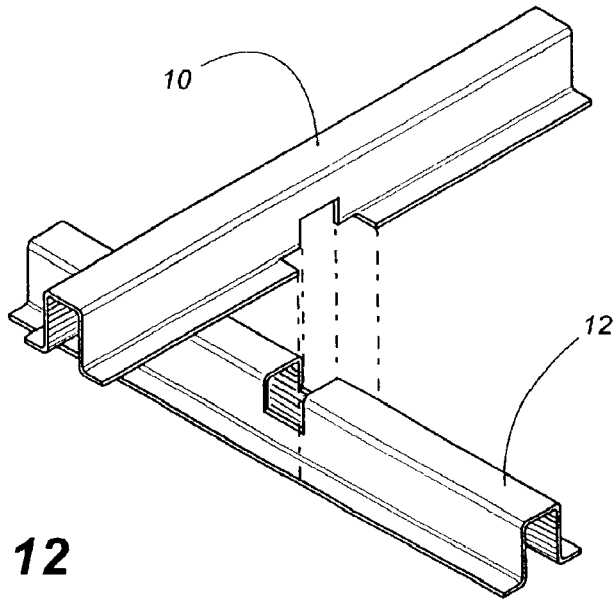
FIG. 12 is an isometric view of the upper and lower cross braces of FIGS. 1–6 being assembled to form a cross brace assembly.
Figure 13:
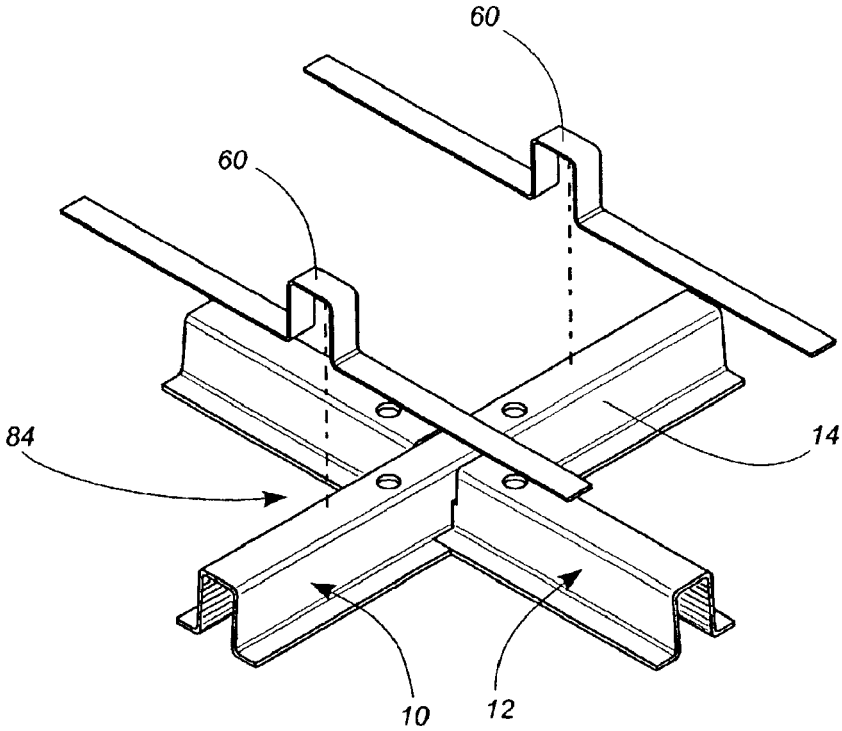
FIG. 13 is an isometric view illustrating the assembly of the base straps of FIG. 9 onto the cross brace assembly.

With most of the individual components of the umbrella stand having now been described, the structure and operation of the umbrella stand will become clear as assembly of the parts is described. Referring first to FIG. 12, the upper cross base member 10 is fitted down over the lower cross base member 12 to form a cross base 84. In FIG. 13, a pair of base supports 60 are positioned in parallel, spaced apart relation over one of the cross base members 10, 12. While it makes no difference which of the two cross base members 10, 12 receive the base supports 60, for purposes of this example the base supports are fitted downward over the channel member 14 of the upper cross base member 10.

Figure 14:
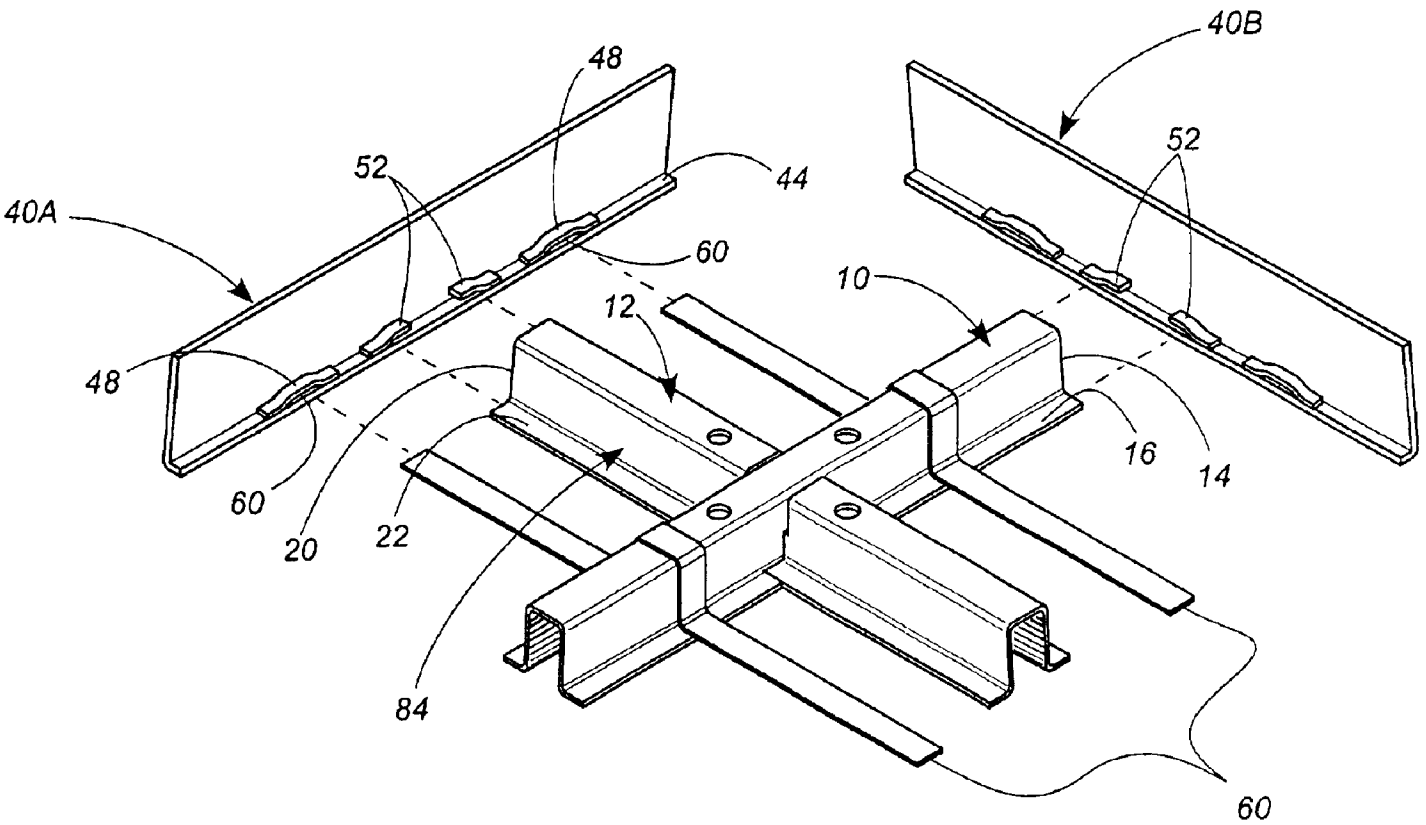
FIG. 14 is an isometric view depicting the assembly of two side frame members of the type illustrated in FIGS. 7–8 onto the assembled cross brace assembly with base straps.

In FIG. 14, two adjoining side frame members 40A, 40B are positioned to be assembled onto the cross base 84 and base supports 60. The ends of the flanges 22 of the lower cross base member 12 are received within the spaced-apart brackets 52 of the side frame member 14A, and the corresponding end of the channel member 20 of the lower cross base member 12 resides within the space between the spaced-apart brackets 52. The corresponding ends of the base supports 60 are snugly received within the apertures 50 defined by the brackets 48 and the bottom flange 44 of the side frame member 40A. Similarly, the ends of the flanges 16 of the upper cross base member 10 are received within the spaced-apart brackets 52 of the side frame member 40B.

Figure 15:
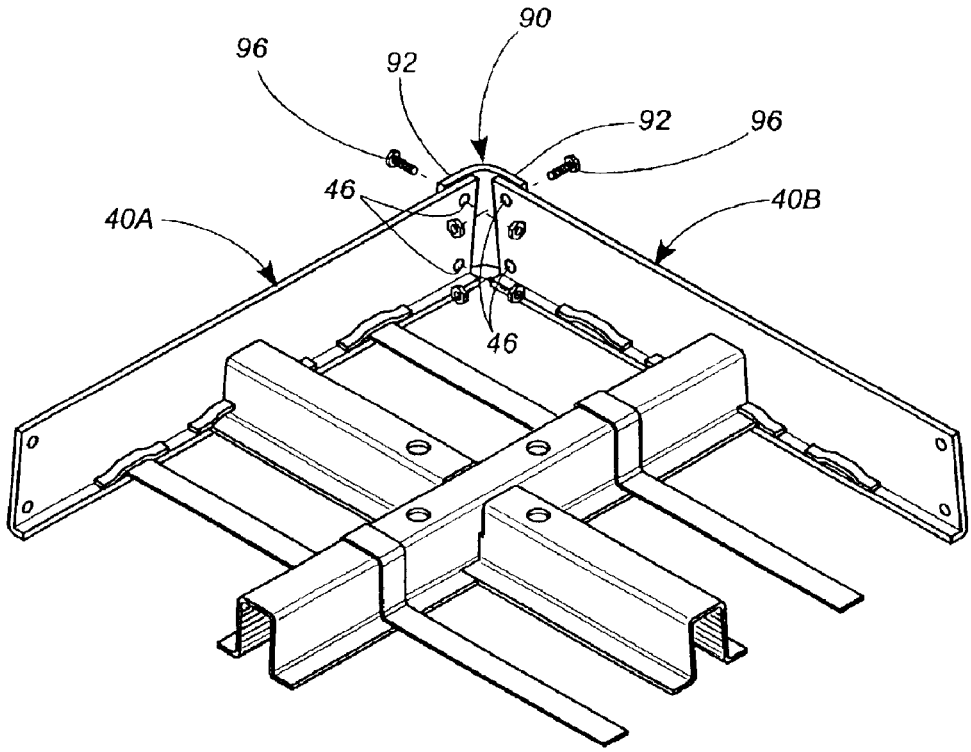
FIG. 15 illustrates the mounting of an angle tie-in to secure the two side frame members together.

Referring now to FIG. 15, an angle tie-in 90 of shaped metal, molded plastic, or other suitable material includes perpendicular wings 92 which overlie adjacent ends of the side frame members 40A, 40B. Holes are formed in the wings 92 in alignment with the corresponding smooth bores 46 in the side frame members 40A, 40B. Threaded fasteners 96 are inserted through the holes in the wings 92 and the bores 46 in the side frame members 40A, 40B to secure the side frame members to the angle tie-in 90.

Figure 16:
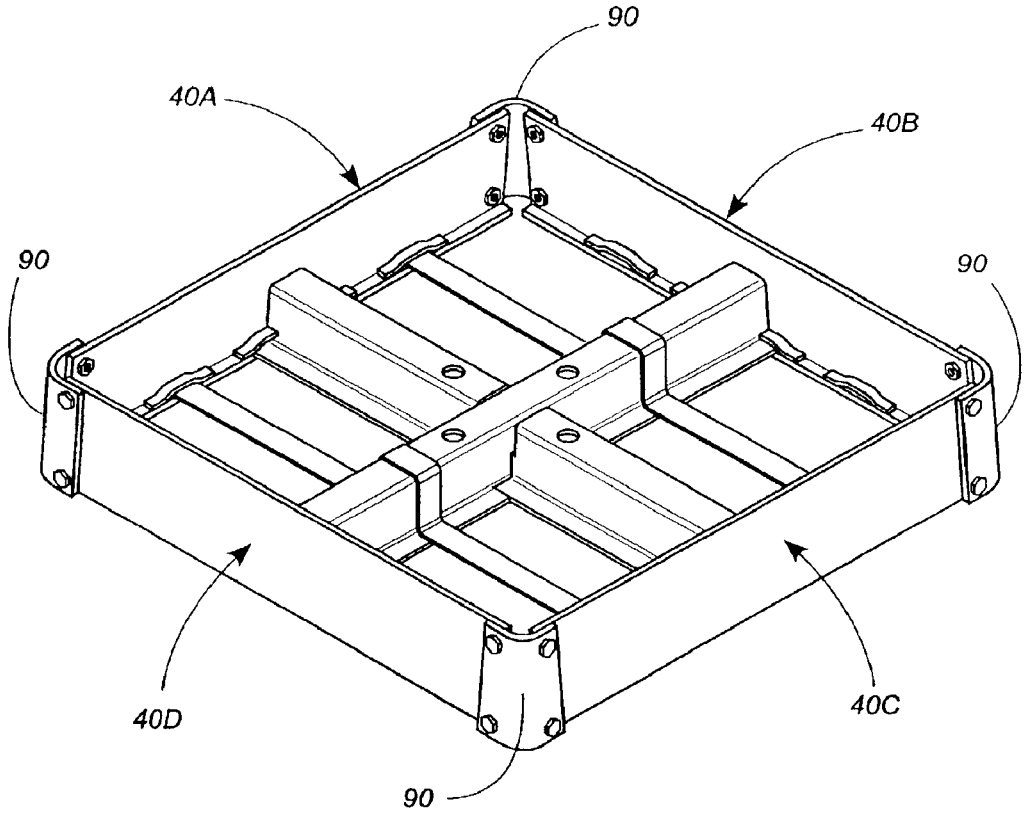
FIG. 16 illustrates the mounting of the remaining side frame members and angle tie-ins.

The remaining two side frame members 40C, 40D and the remaining three angle tie-ins 90 are installed in similar fashion, as shown in FIG. 16. With the angle tie-ins 90 thus installed, the angle tie-ins and the side frame memebers 40 form a closed rectangle, with the angle tie-ins forming corner members of the rectangle.

Figure 17:
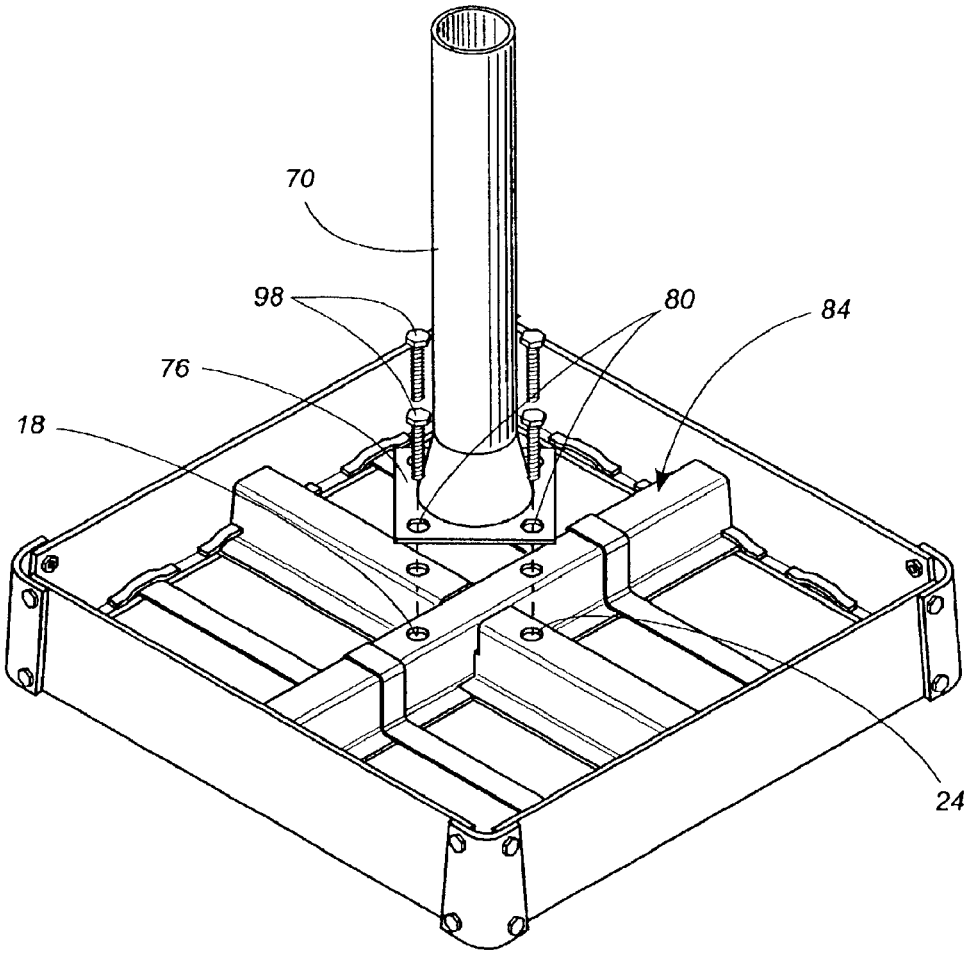
FIG. 17 shows the mast receiver of FIGS. 10 and 11 being mounted to the cross brace assembly.

FIG. 17 shows the mast receiver 70 being installed onto the cross base 84. The base plate 76 of the mast receiver 70 is positioned such that the smooth bores 80 in the corners of the base plate are aligned with the threaded bores 18, 24 in the upper surfaces of the upper and lower cross space members 10, 12 respectively. Threaded fasteners 98 are inserted through the smooth porous 80 in the quarters of the base plate 76 and threaded into the threaded bores 18, 24 in the upper and lower cross base members 10, 12 to anchor the mast receiver 70 to the cross base 84.

Figure 18:
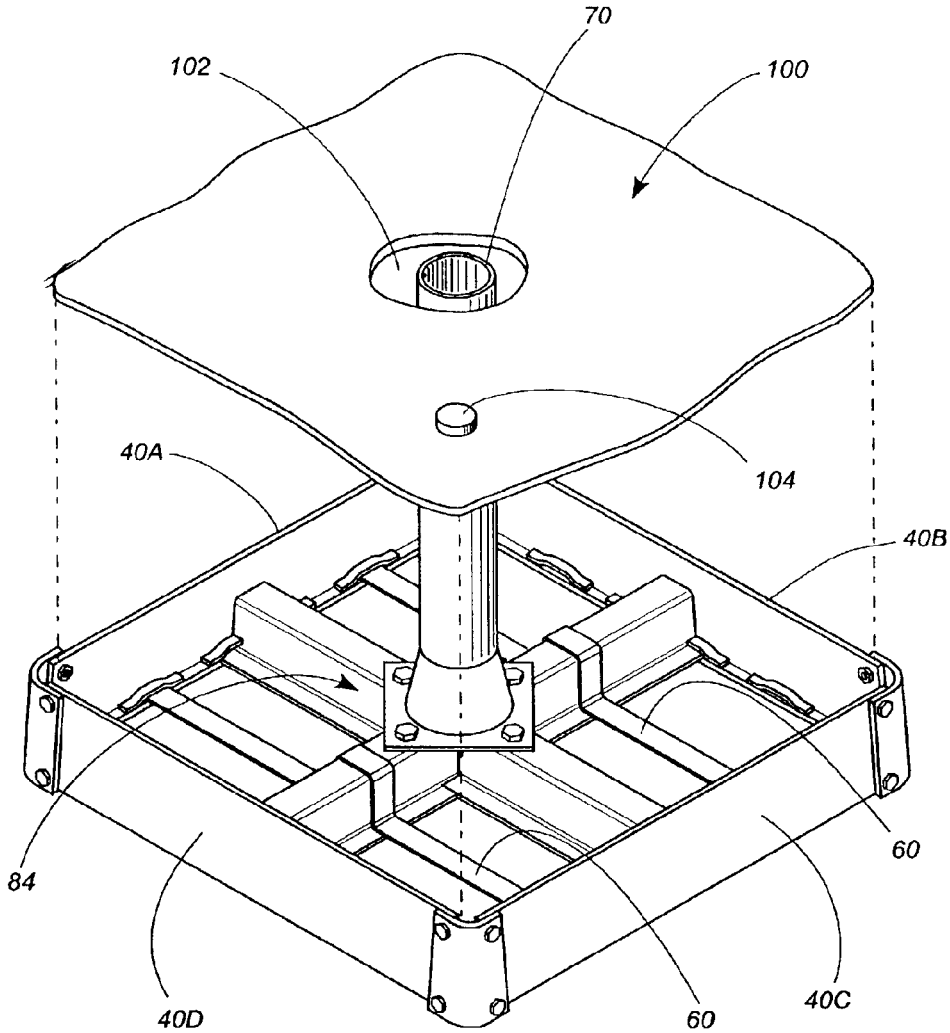
FIG. 18 depicts an empty bladder been positioned over the mast receiver and into the cavity defined by the side frame members.

FIG. 18 shows a bladder 100 formed from flexible plastic or other suitable material. The bladder 100 is somewhat annular and has a central hole 102 and a filler cap 104. Beneath the filler cap 104 is a port through which ballast material can be introduced into the bladder 100. The bladder 100 is inserted downward over the tubular portion of the mast receiver 70 until it resides within the cavity formed by the side frame members 40 A–D.

Figure 19:
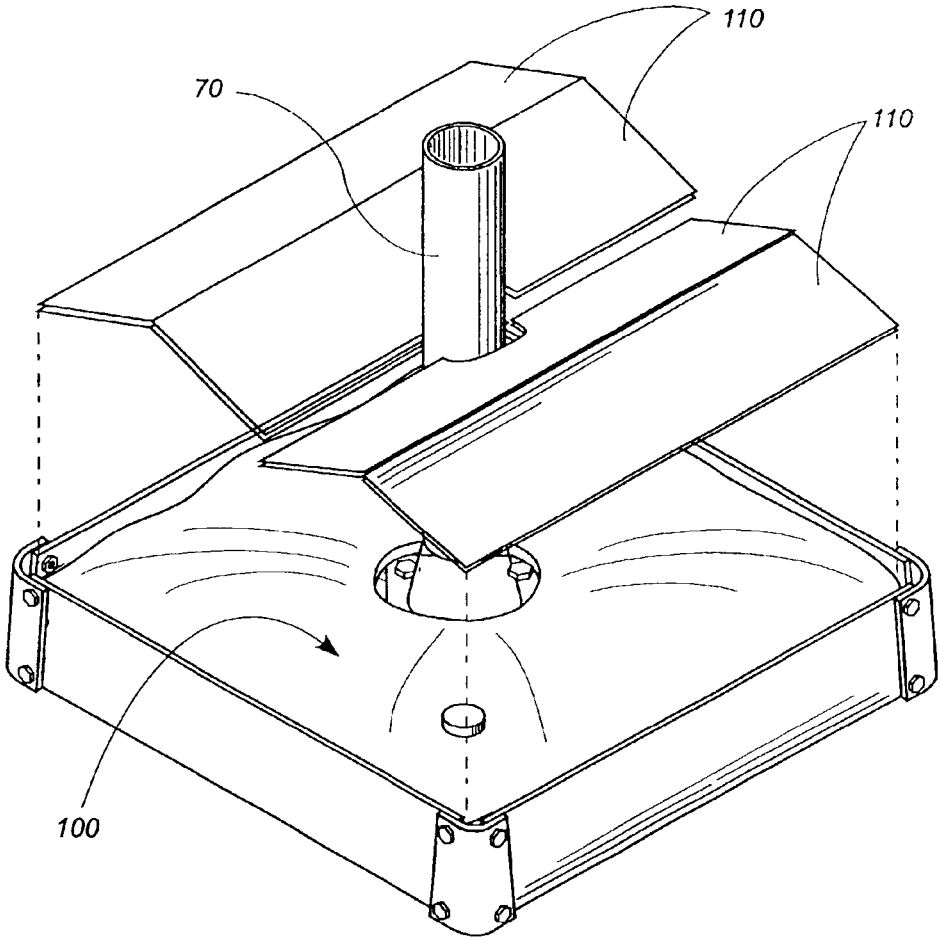
FIG. 19 illustrates the assembly with the bladder now filled with ballast and with a pair of hinged top panel assemblies being positioned around the mast receiver.
Figure 20:
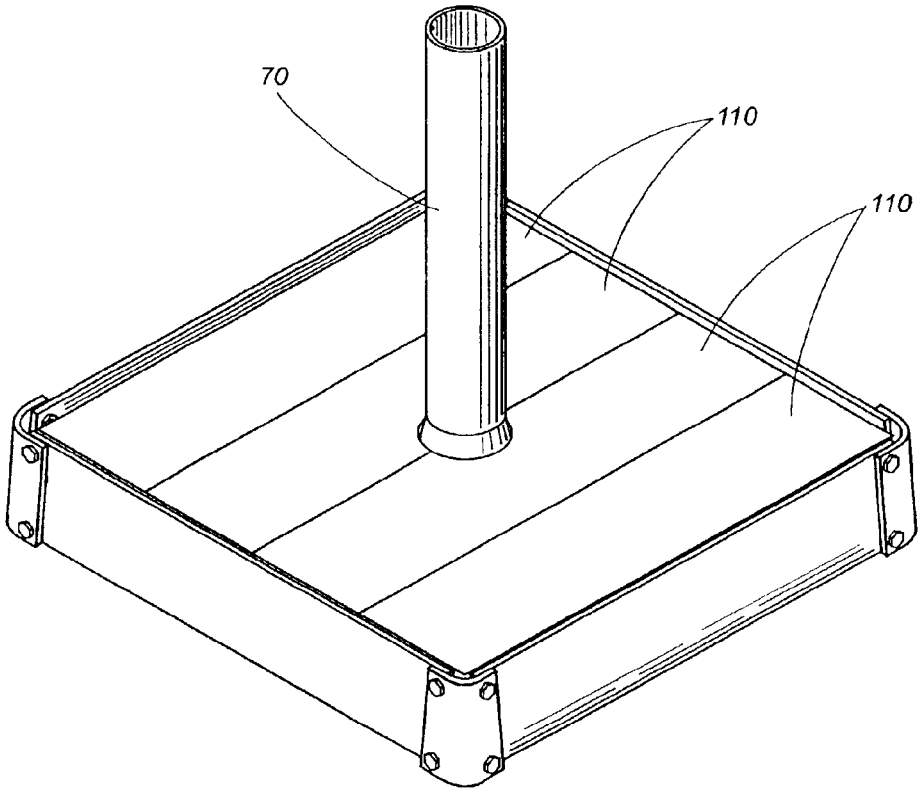
FIG. 20 shows the assembly with top panels installed and with the stand ready to receive the mast of an umbrella.

The bladder 100 is then filled with a suitable ballast material such as water, sand, or a mixture of the two. As the bladder 100 is filled, it settles down around the cross base 84 and onto the base supports 60. When filled, the bladder assumes the general configuration illustrated in FIG. 19. Then, as further shown in FIG. 19, a plurality of cover panels 106 are positioned atop the base to conceal the bladder 100. In the disclosed embodiment, there are two sets of two cover panels 106 each, with each pair being connected by hinges. Adjacent edges of two cover panels 106 have semicircular recesses to fit around the mast receiver 70. The assembled umbrella stand 108 with cover panels 106 in place is shown in FIG. 20, ready to receive the mast of an umbrella within the upper end of the mast receiver 70.

Figure 21:
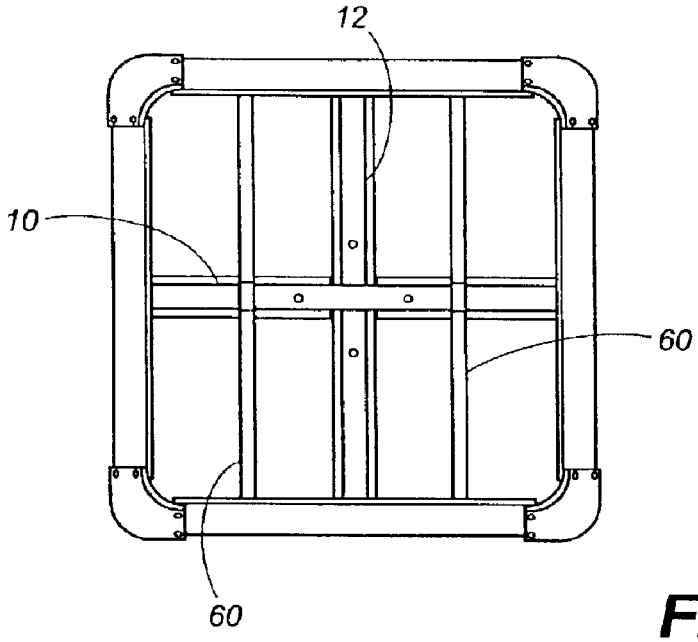
FIG. 21 is a top view of the cross brace assembly, base straps, side frame members, and angle tie-ins of the first embodiment of the umbrella stand.
Figure 22:
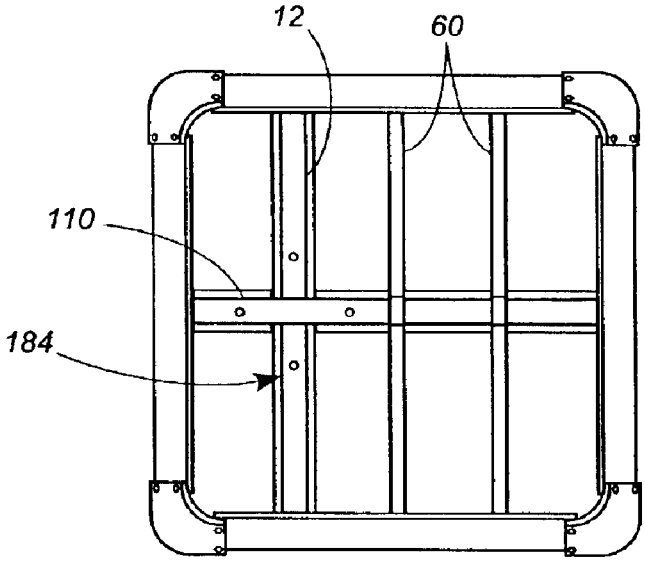
FIG. 22 is a top view of a cross brace assembly, base straps, side frame members, and angle tie-ins of a second embodiment of an umbrella stand.
Figure 23:
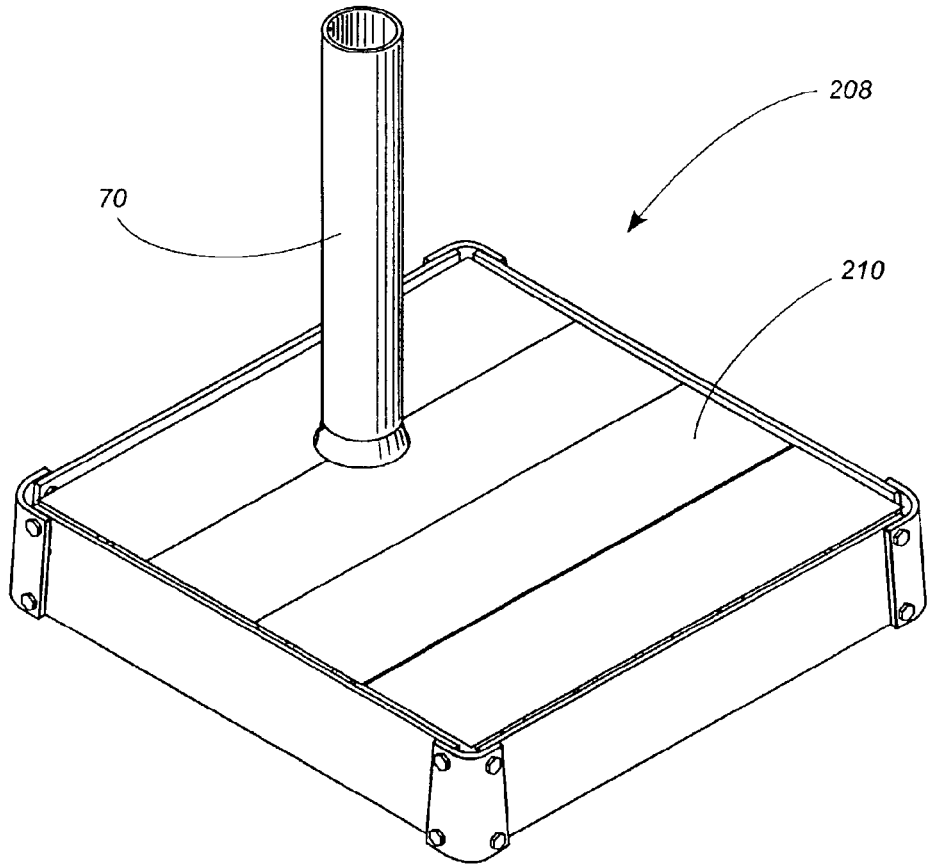
FIG. 23 is an isometric view of an umbrella stand comprising the elements of FIG. 22.

FIG. 21 is a top view of the assembly of FIG. 16. The upper and lower cross brace members 10, 12 intersect at their respective centers, and the base supports 60 are spaced on either side of the lower cross brace member 12. In contrast, an alternate embodiment is depicted in FIG. 22 which has the lower cross brace member 12 intersecting an upper cross brace member 110 at a location approximately one-quarter of the distance along the upper cross brace member to form an asymmetrical cross base 184. Both base supports 60 are on the same side of the lower cross base member 12 at approximately the midpoint and the three-quarter point along the length of the upper cross brace member 110. The purpose of the asymmetrical cross base 184 is to provide an umbrella stand 208 having the mast 70 positioned at a location on the base which is offset from center, as shown in FIG. 23, to place a greater proportion of the weight of the base on the opposite side of the mast 70 from the side-support umbrella (not shown). Panels 210 covering the stand 208 are reconfigured as compared to the panels 110 of the first embodiment 108 to accommodate the off-center mast location.

The umbrella stand of the present invention provides a number of advantages over known umbrella stands. There is no need for the user to lug heavy ballast to the stand, or to maneuver a heavily weighted stand from one location to another. Instead, the frame components can be assembled, either at the location of intended use or at another more convenient location and then carried to the point of use, without the need to carry any ballast. The user then simply gets a conventional garden hose and extends it from a spigot to the umbrella stand and fills the bladder with water with the stand at its intended location of use. (Toward this end, the filler cap 104 can be provided with a female mating portion into which the male end of a garden hose can be screwed.).

An unexpected consequence of using water as ballast for the umbrella stand is that the water tends to give the umbrella stand a "self-righting" propensity. If a strong wind begins to blow the umbrella over, the water in the bladder 100 will initially move in the direction that the wind is blowing. But constrained by the bladder, the water will then slosh back in the opposite direction, shifting weight in a direction which tends to return the umbrella to its upright position.

Also, when broken down into its component parts, the stand has no pieces which are greater than about nine inches in width. The entire stand can thus fit within a standard umbrella box, which measures approximately six inches by ten inches.

Further, there is no need to acquire separate components—such as cinder blocks, heavy weights, etc.—to make the stand ready for use. All of the components, including the ballast-holding bladder, are contained within the same box within which the umbrella is shipped.

Materials other than water may be used as ballast. For example, the bladder may be filled with sand, which can be added at the point of use. To make the ballast even heavier, water can be added to the sand. Wet cement could be used and permitted to dry within the bladder. Any suitable "flowable" material which will generally conform to the bladder could make suitable ballast.

Finally, it will be understood that the preferred embodiment has been disclosed by way of example, and that other modifications may occur to those skilled in the art without departing from the scope and spirit of the appended claims.

What is claimed is:

1. An umbrella stand, comprising:

a base comprising a plurality of generally upright, interconnected walls and defining a cavity therewithin;

mast receiving means operatively associated with said base;

a bladder received within said cavity and comprised of a material which will retain ballast;

ballast contained within said bladder;

a brace assembly mounted within said cavity and coupled to said generally upright walls, said mast-receiving means being mounted to said brace assembly;

whereby when a mast of an umbrella is inserted into said mast receiving means and said umbrella is raised, said ballast weighs down said base so as to maintain said umbrella in a generally upright condition.

2. The umbrella stand of claim 1, wherein said bladder is comprised of a material which will retain water, and wherein said ballast comprises water.

3. The umbrella stand of claim 1, further comprising a plurality of panels disposed on said means defining a cavity and above said bladder so as to form an upper surface of said umbrella stand.

4. The umbrella stand of claim 3, further comprising hinge means for joining an adjacent two of said plurality of panels.

5. The umbrella stand of claim 1, further comprising a base strap operatively associated with said brace assembly and said generally upright walls, said base strap being operative to support a lower portion of said bladder.

6. The umbrella stand of claim 5, wherein said generally upright walls include means defining a channel for receiving a portion of an end portion of said brace strap.

7. The umbrella stand of claim 6, wherein said generally upright walls comprise an inwardly extending flange at a lower end thereof, and wherein inwardly extending flange defines a portion of said channel for receiving said end portion of said brace strap.

8. The umbrella stand of claim 1, wherein said generally upright walls comprise an inwardly extending flange at a lower end thereof.

9. The umbrella stand of claim 1, wherein said generally upright walls include means defining a channel for receiving a portion of an end portion of said brace assembly.

10. The umbrella stand of claim 9, wherein said generally upright walls comprise an inwardly extending flange at a lower end thereof, and wherein inwardly extending flange defines a portion of said channel for receiving said end portion of said brace assembly.

11. The umbrella stand of claim 1, wherein said bladder comprises a hole therethrough, and wherein said mast receiving means extends upward through said hole in said bladder.

12. An umbrella stand, comprising:

a base defining a cavity therewithin, said base comprising a predetermined number of corner members; and a corresponding predetermined number of side panels, each of said side panels having first and second ends releasably connected to a different first and second ones of said corner members;

whereby said side panels and said corner members are releasably connected to define a cavity;

mast receiving means operatively associated with said base;

a bladder received within said cavity and comprised of a material which will retain ballast; and ballast contained within said bladder;

whereby when a mast of an umbrella is inserted into said mast receiving means and said umbrella is raised, said ballast weighs down said base so as to maintain said umbrella in a generally upright condition.

13. The umbrella stand of claim 12, wherein said predetermined number of corner members and side panels is four.

14. The umbrella stand of claim 13, wherein said releasably connected side panels and corner members define a rectangle.

* * * * *